United States Patent [19]

Charles

[11] 4,041,900

[45] Aug. 16, 1977

[54] PIVOTED GUIDE MEANS FOR SELECTIVE IMMERSION OF WEB FEED

[76] Inventor: James H. Charles, 2506 Blount Ave., Maryville, Tenn. 37801

[21] Appl. No.: 681,778

[22] Filed: Apr. 30, 1976

[51] Int. Cl.[2] ..... B05C 3/12

[52] U.S. Cl. ..... 118/419; 68/175; 118/425

[58] Field of Search ..... 118/419, 420, 423, 424, 118/425; 68/175; 427/430–434; 312/102

[56] References Cited

U.S. PATENT DOCUMENTS

| | | | |
|---|---|---|---|
| 1,351,901 | 9/1920 | Gingras | 118/49 X |
| 2,031,772 | 2/1936 | Hall | 118/419 |
| 2,308,168 | 1/1943 | Garson | 118/49 |
| 2,581,638 | 1/1952 | Deering | 118/419 X |
| 3,084,664 | 9/1963 | Perlman et al. | 118/235 |

*Primary Examiner*—Morris Kaplan

*Attorney, Agent, or Firm*—Fitch, Even, Tabin & Luedeka

[57] ABSTRACT

Method and apparatus for dispensing a web of absorbent material selectively in a dry or wetted condition, including means for holding an indeterminate length of web material and drive rolls defining a nip therebetween through which the web is threaded for dispensing. Guide means provided intermediate the drive rolls and the web supply selectively guides the web over the surface of fluid contained in a reservoir or dips a length of the web beneath the surface of the fluid. Forward rotation of the drive rolls dispenses a length of web. In one embodiment, by reason of means interconnecting the guide and a drive roll, reverse rotation of the drive rolls causes the guide to engage the web and move a length of web into contact with the fluid contained in the reservoir. Subsequent forward rotation of the drive rolls dispenses a length of wetted web and moves the guide to a position for guiding the web above the surface of the fluid.

3 Claims, 4 Drawing Figures

PIVOTED GUIDE MEANS FOR SELECTIVE IMMERSION OF WEB FEED

This invention relates to apparatus for dispensing lengths of web material such as toweling or toilet tissue, and particularly relates to selectively dispensing of wet or dry web material.

In a variety of hygienic and medicinal applications, it is desirable to use toweling or tissue webs that are wet such as for cleansing, or dry for removing wetness. Heretofore, different toweling was required for these different functions.

In certain cleansing operations, such as cleaning the human body following a fecal elimination, it is desirable that the toweling or tissue be wetted prior to wiping to enhance its cleansing effect while reducing irritation or injury caused by abrasion as may occur when a dry web is rubbed against hemmoridal tissues. On the other hand, when toweling absorbency is important, as in using a length of toweling for drying or as an applicator of a medicinal agent, dry toweling is desirable.

Heretofore, it has been known to dispense wet toweling as from a package containing a fluid, such as a cleansing agent. Paper toweling with the requisite wet strength to withstand prolonged exposure to a fluid is generally heavier and course, hence undesirable for use in cleansing delicate tissue. For this reason, in applications requiring cleansing delicate tissues it is desirable to use a soft web such as toilet tissue or the like. These webs commonly have only limited wet strength so that special handling is required when these webs are wetted.

It is therefore an object of this invention to provide an improved web dispensing apparatus. It is another object of this invention to provide an apparatus for dispensing a continuous web of absorbent material selectively in a dry or wetted condition. Another object of this invention is to provide a web dispenser which is both portable and suitable for use as a fixture.

These and other objects of the invention will become apparent from reading the following specification and claims taken together with the accompanying drawings wherein:

Figure 1:
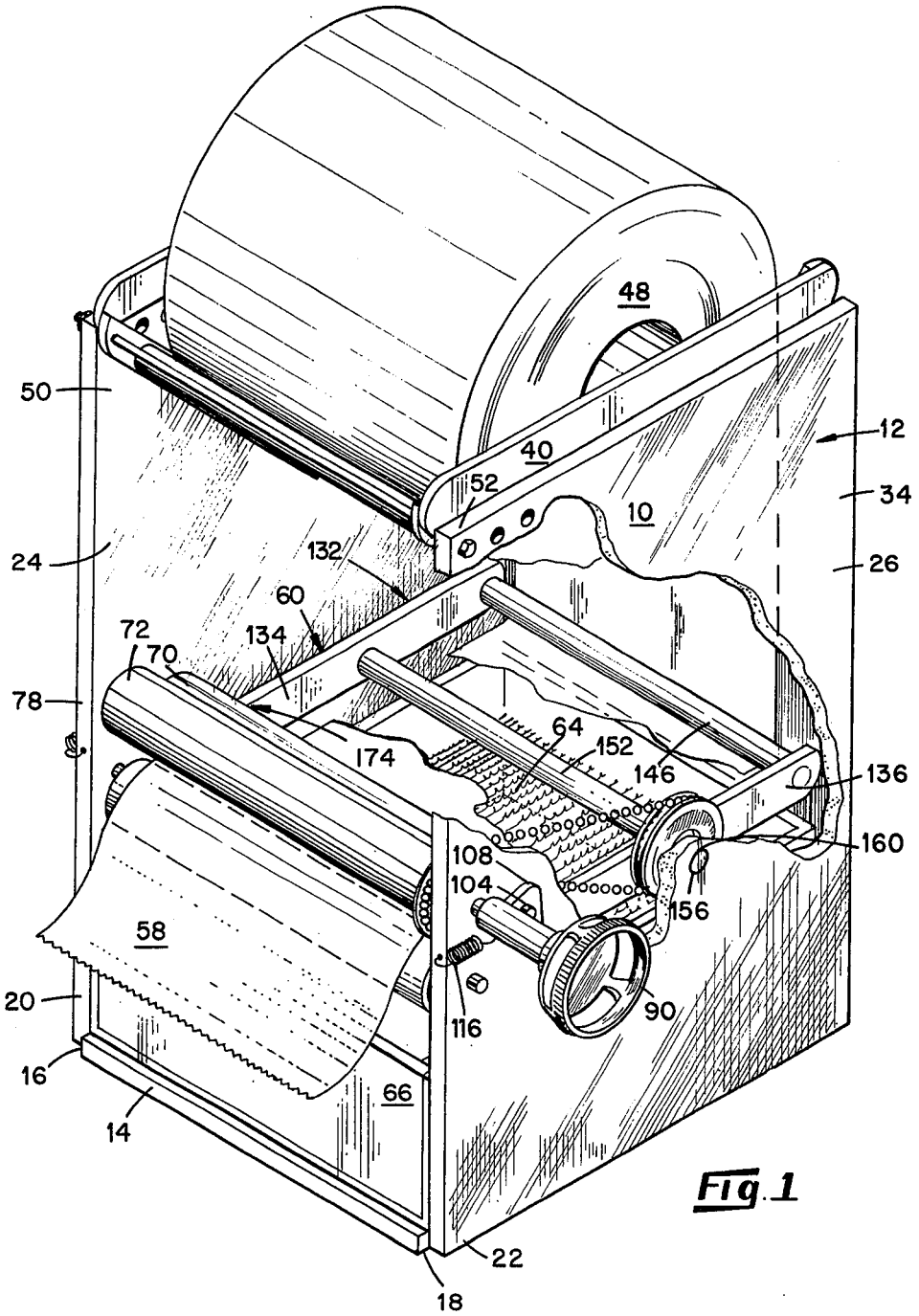
FIG. 1 is a perspective view of a web dispenser showing various features of the invention.

In accordance with the present disclosure, there is provided a method and apparatus for dispensing a web of absorbent material selectively in a dry or wetted condition and including a frame and means mounted on the frame for supporting an indeterminate length of web. A reservoir for containing a quantity of fluid is disposed upstream of a pair of cooperating drive rolls defining a nip therebetween for engaging and dispensing the web. Guide means supported on the frame guides the web across the surface of the fluid as the drive rolls are rotated in a forward direction. In one embodiment, means interconnecting the drive rolls and the guide means provide for movement of the guide to immerse at least a portion of the web length in the fluid upon reverse rotation of drive means for the drive rolls.

Referring to the Figures, an apparatus for dispensing a continuous web of absorbent material selectively in a dry or wetted condition and constructed in accordance with the present invention is indicated generally at 10. This dispenser finds particular application as a portable unit or as a fixture mounted on a wall. The illustrated dispenser 10 includes a frame 12 carrying various elements of the unit and fabricated of a suitable sheet material such as metal or plastic for example. The illustrated frame 12 includes a planar base 14 having opposite side edges 16 and 18 secured to the lower edges 20 and 22 of upstanding side walls 24 and 26, respectively. The rear portion 28 of the frame 12 is closed by an upstanding rear wall 30 joined along its side edges 16 and 18 to rear edges 32 and 34 of the side walls 24 and 26, respectively. The rear wall 30 is further secured along its lower edge to the rear edge 36 of the base 14 to define a housing for the dispenser. A suitable cover (not shown) may be secured to the housing to exclude dust and debris as desired. In the depicted embodiment, the front of the dispenser is open, but it is recognized that an appropriate front wall can readily be provided as desired.

Support means is mounted in the top portion 38 of the frame 12 for supporting a continuous length of web for dispensing. In the illustrated embodiment, the continuous web is in the form of a roll and the support means comprises a cradle 40 including side sections 42 and 44 connected to one another by transverse rods 46 to define a cavity of triangular configuration for supporting the roll 48. Each of the depicted rods is provided with a loose fitting tubular covering 47 that functions in the manner of a roller.

The spacing of the rods 46 provides support for a roll of diminishing diameter as the web is dispensed. To facilitate access to the interior of the dispenser for purposes of maintenance or threading the web, the illustrated cradle 40 is pivotally mounted between the top forward corners 50 and 52 of the side walls 24 and 26. The rear edge 54 of the cradle engages the top edge 56 of the rear wall 30 of the frame to position the cradle and the roll therein for feeding the web into the interior of the dispenser.

The web 58 is fed from the supply roll 48 about a guide means 60 disposed within the frame 12 at a location above the surface 62 of a quantity of fluid 64, water for example, contained in a reservoir 66, thence to and through a nip 68 defined by a set of drive rolls 70 and 72.

To draw a desired length of web from the dispenser, the set of cooperating drive rolls 70 and 72 are mounted for rotation adjacent the forward edge 78 of the dispenser at substantially the vertical midportion of the side walls 24 and 26. The illustrated rolls comprise the freely-rotatably cylindrical roll 70 mounted at its opposite ends 82 and 84 in appropriate openings 86 and 88 in the side walls 24 and 26, and a substantially parallel aligned cylindrical drive roll 72, the rolls 70 and 72 defining a nip 68 therebetween for receiving the web for dispensing. The drive roll 72 preferably is provided with an exposed roughened surface for frictionally engaging a web disposed in the nip 68. The depicted rolls 70 and 72 extends across the width of the dispenser housing with the drive roll 72 having its opposite ends rotatably mounted in openings 83 and 85, respectively, provided in the side walls 24 and 26. As depicted, one end 89 of the drive roll 72 is proportioned to extend through the opening 85 in the side wall 26 and project therebeyond substantially normally with respect to the side wall 26 to receive a turn knob 90 or other means for rotating the drive roll. Alternatively, an elongated L-shaped crank may be substituted for the knob 90 to provide increased leverage in rotating the drive roll.

The desired engagement between the drive rolls 70 and 72, is ensured by biasing the roll 70 in a direction toward the drive roll 72 as by springs 114 and 116, with the surface of the drive roll 70 under the influence of the spring bias. In this connection, the openings 86 and 88 through which the opposite ends 82 and 84 of the roll 70 extend define elongated slots in the side walls of the housing. The roll ends 82 and 84 further extend beyond the outer surfaces of the side walls to be received through openings 102 and 104 in substantially planar fittings 106 and 108, respectively, positioned adjacent the outer surfaces of the side walls 24 and 26. The fitting openings 102 and 104 are proportioned for rotatably receiving the roll ends. The fittings further are anchored by tensioning springs 114 and 116 to the forward edge surfaces 118 and 120 of the housing side walls 24 and 26, respectively, thereby biasing the roll 70 into engagement with the drive roll 72 for positively engaging a length of web disposed therebetween.

As noted above, reservoir means is provided for containing a quantity of liquid, e.g. water, into which the web is selectively guided to selectively provide a length of wetted web. The illustrated reservoir 66 comprises a substantially rectangular tray having a planar base 122 supported on the base 14 of the frame 12. Upright walls 124, 126, 128 and 130 define the perimeter of the reservoir, with its top being open to expose the liquid therein.

As referred to above, the web 58 is guided over the surface of fluid contained in the reservoir for purposes of dispensing dry web. To this end, a generally planar guide means 60 is provided intermediate the rolls and the web supply and comprises a frame 132 including substantially parallelly aligned elongated side members 134 and 136 joined at their respective opposite ends by cylindrical rods 146 and 148 of individual lengths which proportion the guide means for its entering into the reservoir 66 for reasons described more fully hereinafter. To facilitate movement of the web over the elongated rods 146 and 148 during dispensing operations, each of the rods 146 and 148 preferably is provided with loose-fitting cylindrical covering rotatably mounted thereon to reduce the frictional drag on the web as it is moved over the rods.

To selectively dispense a length of wetted web, the web in engagement with the guide means is lowered into the liquid contained in the reservoir. To this end, the guide means 60 in one embodiment is pivotally mounted in the frame 12 by an elongated shaft 152 having its opposite ends 154 and 156 rotatably received in openings in the side walls 24 and 26. The shaft 152 is fixedly secured to the side members 134 and 136 of the guide means 60 at a location approximately equidistant from the opposite ends of the side members so that rotation of the shaft 152 causes a like rotation of the guide means. One end 154 of the shaft 152 extends fully through the side wall 26 and projects therefrom to receive a knob 155 fixedly secured thereto for manual rotation of the shaft 152 and positioning of the guide means 60 as referred to hereinafter.

For dispensing dry web, the guide means 60 is positioned in a substantially horizontal plane by appropriate rotation of the knob 155 so that the web passes about the guide means above the surface of liquid 64 contained in the reservoir. In the depicted embodiment, the web is trained about the underside of the rods 146 and 148 on the guide means so that the tension of the web as it is drawn from the supply roll upon rotation of the drive rolls will urge the guide means toward a horizontal position out of contact with the liquid in the reservoir. Stop means such as a lug 172 projecting inwardly from the side wall 26 to be engaged by the side member 136 of the guide serves to limit the rotation of the guide means in response to the web tension and to establish the horizontal position of the guide means.

When it is desired to dispense a quantity of wetted web, in one embodiment, the guide means 60 is rotated by knob 155 for movement of the forward end 174 of the guide means 60, and the web engaged by rod 148, into contact with the liquid 64. Thereafter, forward rotation of the drive roll 72 causes the absorbent web to be drawn through the liquid so long as the guide means is manually held in its immersed position. When the knob 155 is released, the tension on the web as it is dispensed by the drive rolls causes the guide means to rotate to its horizontal position out of the contact with the liquid. The cooperating pair of rolls 70 and 72 serve to evenly distribute the liquid along the web length. If it is no longer desired to dispense a length of wetted web, the guide means 60 is rotated to a substantially horizontal position and the web is guided above the surface of the liquid for dispensation of dry web.

Figure 3:
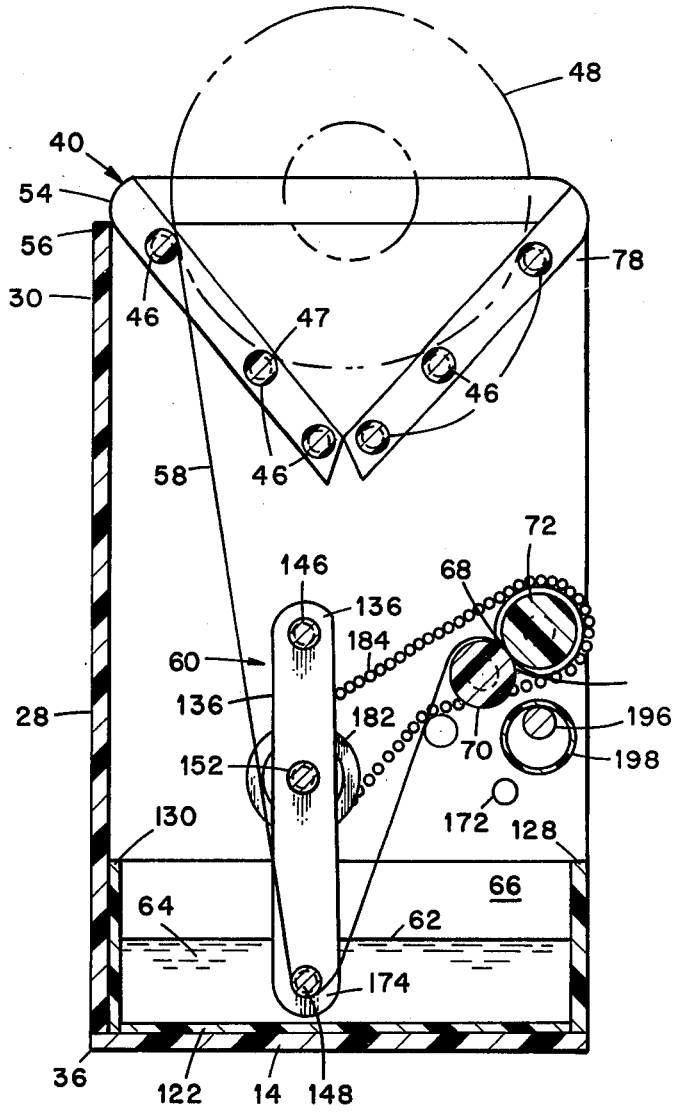
FIG. 3 is a sectional side elevation view of the apparatus shown in FIG. 1 with the guide means rotated into position for wetting the web prior to dispensing.

The above procedure requires the use of two hands. Short lengths of the web can be wetted and dispensed by rotating the drive roll 72 in a reversed direction, i.e. clockwise as seen in FIG. 3, by turning the knob 90 attached to the end 89 of the drive roll 72, followed by rotation of this drive roll in its forward direction. To this end, in the illustrated embodiment, means are provided for interconnecting the drive roll 72 with the shaft 152 on the guide means so that rotation of the drive roll 72 in a reverse direction results in rotation of the guide means to immerse a length of web carried by the guide means into the liquid. In the illustrated embodiment, the drive roll 72 and the shaft 152 are interconnected by drive means comprising a friction clutch 166 and an accompanying sprocket 168 mounted on the end 89 of the drive roll. In one embodiment, this clutch 166 comprises a conventional overriding clutch or it may comprise a grommet fabricated from a suitable, flexible material such as leather, proportioned for fitting snugly over the end 89 of drive roll 72 between the end of the drive roll 72 and the inner surface of side wall 26 of the housing and within an appropriate central opening through a sprocket 168. This sprocket 168 is connected in driving relation by a chain 184 or the like to a cooperating sprocket 182 fixedly mounted to the shaft 152 of the guide means. By this means, when the knob 90 is rotated in a counterclockwise direction (as seen in FIG. 1), the sprocket 168 is rotated in a like direction. Acting through the chain 184, the rotation of the sprocket 168 functions to rotate the sprocket 182 and the guide means 50 in a counterclockwise direction also causing the forward end 174 to dip a length of the web into the liquid in the reservoir 66. During this operation, the friction clutch affords the necessary engagement between the drive roll 72 and the sprocket 168 to effect the rotation of the guide means.

Thereafter, the knob 90 is rotated in the clockwise direction to dispense the wetted web. This same clockwise rotation tensions the web and drives the chain 182 to pull the end 174 of the guide means toward the horizontal until the guide means engages the stop 172 whereupon the friction clutch 166 commences slipping to permit further rotation of the drive roll to dispense the web. It will be recognized by one skilled in the art that the clutch means 166 alternatively can be mounted on the shaft 152 of the guide means rather than on the drive roll 72.

Figure 2:
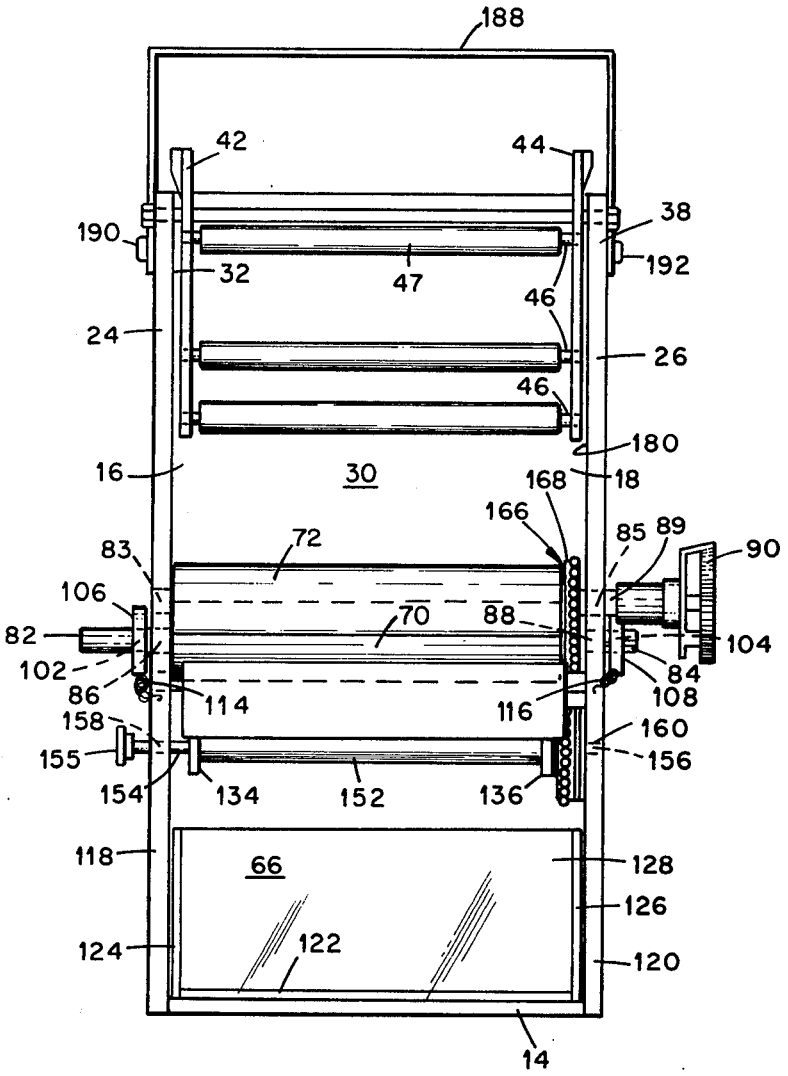
FIG. 2 is a front elevation view of the apparatus shown in FIG. 1.

For portability purposes, the dispenser 10 is provided with a handle 188 shown in FIG. 2. The illustrated handle 188 extends across the top portion of the housing and is secured to the side walls 24 and 26 of the housing as by brads 190 and 192, or the like.

In order to prevent the leading end of the web dispensed during forward rotation of the drive rolls from being fed back into the dispenser or adhering to the roll 70, an elongated rod 196 is supported at its opposite ends by frame walls 24 and 26 in position to receive the dispensed web thereover so that the length of web is guided outwardly from the front of the dispenser as shown in FIG. 1. In the illustrated embodiment, the rod 196 is provided with loosely fitted cylindrical cover 198. In an alternative embodiment a suitable apron or the like may be substituted for the illustrated rod 196 to assist in guiding the dispensed web from the front of the dispenser.

In operation, a roll of indeterminate length web is positioned within the cradle rods 46, and trained about the guide means 60, thence through the nip defined by the drive rolls 70 and 72. A dry length of web is drawn from the supply roll, about the guide means and dispensed by rotating drive roll 72 manually in a forward direction. In this operation, the friction clutch 166 and the sprockets 168 and 182, acting through the chain 184, urge the plane of the guide means 60 to a substantially horizontal position so that the web passes above the surface of the liquid in the reservoir 66.

In one mode of operation, wet web is selectively dispensed in a desirable length by gripping the drive knob 155 on the side of the dispenser and manually rotating the guide means 60 to a position such that the forward end 174 of the guide means is disposed below the surface of liquid 64 causing the web to be wetted as it passes under the roller 146 of the guide means 60. When it is desired to again dispense a dry length of web, the knob 155 is released and the guide means moves to its substantially horizontal position so that the web again passes above the surface of the fluid.

Alternatively wetted lengths of web are dispensed by first rotating the drive roll 72 in a reverse direction to dip the forward end 174 of the guide means into the liquid. Thereafter, the drive roll 72 is rotated in its forward direction whereupon the guide means moves to its substantially horizontal position with the side member 136 of the guide means positioned against the stop 172. In this manner, a length of the wetted web is dispensed followed by a length of dry web. As the wetted web passes into the nip 68 between the drive rolls, excess liquid is squeezed from the web and flows rearwardly to wet the downstream portion of the moving web, thus serving to more evenly wet the web and to distribute the liquid over a greater length of the web when only a relatively short length was immersed initially.

Figure 4:
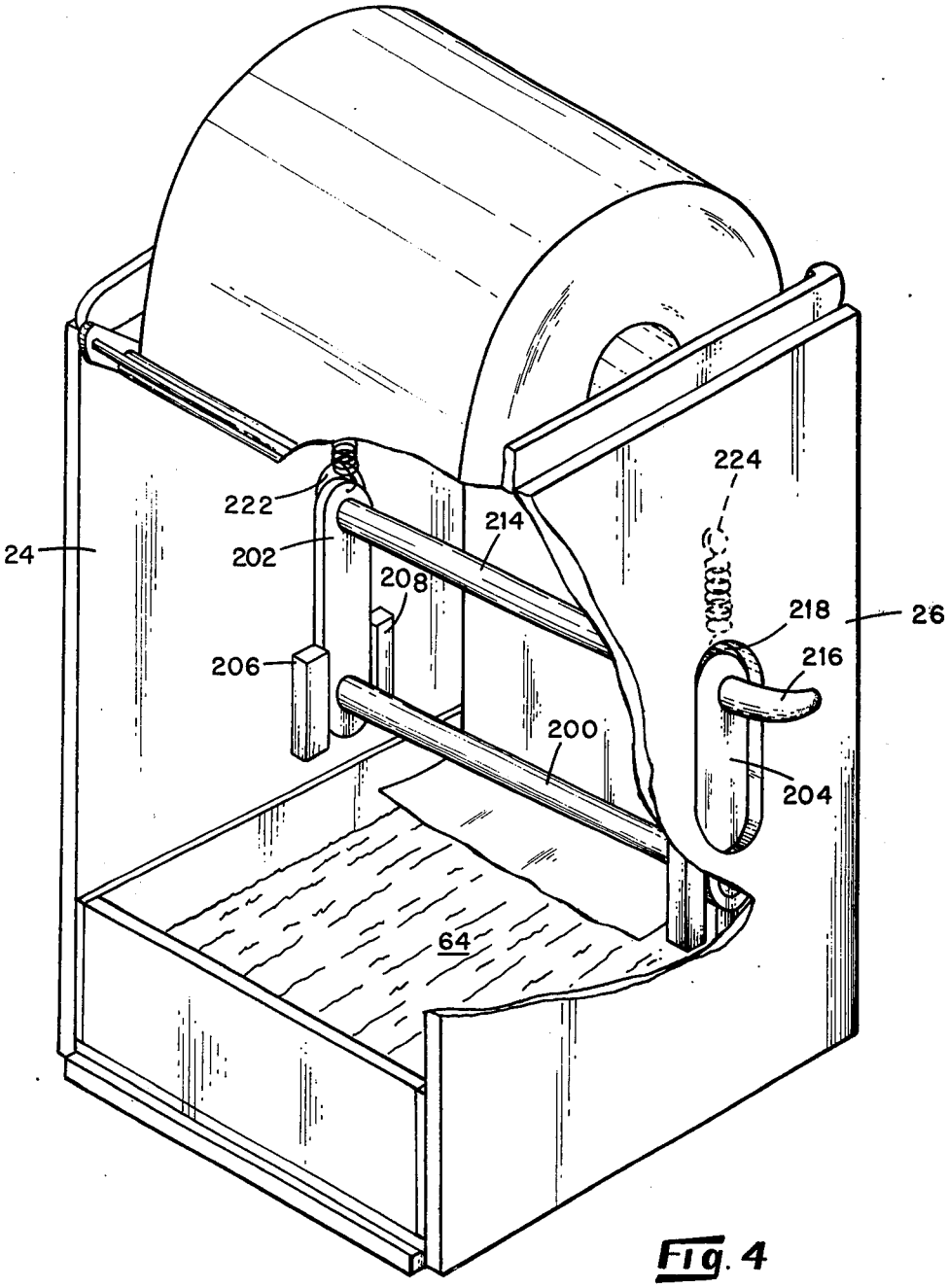
FIG. 4 is a sectional view of the apparatus shown in FIG. 1 having an alternative guide means.

For example, an alternate guide means adopted for selectively guiding the web above and through the liquid 64 contained in the reservoir is shown diagrammatically in FIG. 4 and comprises a roll 200 supported at its opposite end by a set of upright elongated arms 202 and 204. A rod 214 joins the elongated arms to each other and includes an end portion 216 which extends through a slot 218 in side wall 26 of frame 12 and an opposite end portion that projects outwardly through a slot 222 in the side wall 24. The arms 202 and 204 are spring biased upwardly by springs each having one end attached to a respective arm and its opposite end anchored to a lug 224 projecting inwardly of the side wall 26. A length of wetted web is obtained by pushing downwardly on the projection 216 to move a portion of the web into the liquid in the reservoir and rotating the drive rolls 70 and 72 (See FIGS 1–3) in a forward direction. Upon release of the downward pressure against the projection 216, the roll 200 retracts to its position out of the liquid.

Although this invention has been described in terms of the illustrated preferred embodiments, many variations and modifications therein will be apparent to those skilled in the art. Accordingly, it is intended to cover all such variations and modifications which fall within the spirit and scope of the appended claims.

What is claimed is:

1. An apparatus for dispensing a web of absorbent material selectively in a dry or wetted condition comprising:

frame means, means mounted on said frame means for rotatably supporting a roll of said web, reservoir means containing a quantity of liquid disposed within said frame, manually operable drive roll means including a set of drive rolls mounted for rotation in said frame means and defining a nip therebetween through which said web is threaded, said drive rolls positively engaging said web threaded through said nip whereby forward rotation of said drive rolls draws said web from said roll and dispenses the same outwardly from said frame means, guide means mounted in said frame means for guiding said web along a path including a section spaced from said liquid and movable to a position for guiding said web into contact with said liquid in said reservoir, drive means including clutch means interconnecting said drive roll means and said guide means for movement of said guide means between a position for guiding said web into contact with said liquid upon reverse rotation of said drive roll means and a position for guiding said web along said section of said path spaced from said liquid upon forward rotation of said drive roll means.

2. The apparatus of claim 1 wherein said means interconnecting said drive rolls and said means for guiding said web includes first gear means mounted on one of said drive rolls, further gear means mounted on said means for guiding said web, and flexible loop means connecting said first and further gear means in driving relationship.

3. The apparatus of claim 2 wherein said clutch means comprises a friction disc.

* * * * *